US010850311B2

(12) United States Patent
Peng et al.

(10) Patent No.: US 10,850,311 B2
(45) Date of Patent: Dec. 1, 2020

(54) PRESS WATER DROP HEAD DEVICE CONVENIENT FOR CLEANING AND HAVING LOW NOISE

(71) Applicant: GUANGZHOU SEAGULL KITCHEN AND BATH PRODUCTS CO., LTD., Guangzhou (CN)

(72) Inventors: Qianfeng Peng, Guangzhou (CN); Mingzi Zhang, Guangzhou (CN); Kunhua Zhong, Guangzhou (CN); Yaling Chen, Guangzhou (CN)

(73) Assignee: GUANGZHOU SEAGULL KITCHEN AND BATH PRODUCTS CO., LTD., Guangzhou (CN)

( * ) Notice: Subject to any disclaimer, the term of this patent is extended or adjusted under 35 U.S.C. 154(b) by 198 days.

(21) Appl. No.: 16/252,441

(22) Filed: Jan. 18, 2019

(65) Prior Publication Data

US 2020/0130028 A1 Apr. 30, 2020

(30) Foreign Application Priority Data

Oct. 29, 2018 (CN) ..... 2018 2 1760188 U

(51) Int. Cl.
*B08B 9/032* (2006.01)

(52) U.S. Cl.
CPC ..... *B08B 9/032* (2013.01)

(58) Field of Classification Search
CPC ..... B08B 9/032
See application file for complete search history.

(56) References Cited

U.S. PATENT DOCUMENTS 1,505,381 A * 8/1924 Eastman ..... G05D 16/12 137/173

* cited by examiner

*Primary Examiner* — Jason Y Ko
(74) *Attorney, Agent, or Firm* — Platinum Intellectual Property LLP

(57) ABSTRACT

The utility discloses a press water drop head device convenient for cleaning and having low noise connected with sewer pipe, comprising bounce component comprising fixing casing, sliding block sleeved in fixing casing, pressing spring, sliding guide rod, cover plate located on fixing casing, sidewall of fixing casing provided with residual hole, and fixing column disposed below residual hole, sliding rail disposed on sliding block, one end of pressing spring connected to bottom end of sliding block, another end disposed in fixing casing, one end of sliding guide rod sleeved on fixing column, another end extending through residual hole into fixing casing to contact sliding rail, a pair of protrusions disposed on outer circumference of fixing casing, clamp hole disposed on sewer pipe and matched with protrusions. The utility has simple and compact structure, reduces noise, and can be quickly removed of bounce component, saving time, safety, energy-saving and environmental protection.

9 Claims, 4 Drawing Sheets

PRESS WATER DROP HEAD DEVICE CONVENIENT FOR CLEANING AND HAVING LOW NOISE

TECHNICAL FIELD

The utility relates to the fields of drainage equipment, in particular to a press water drop head device convenient for cleaning and having low noise.

BACKGROUND

Press water drop head device is an indispensable component of the press drain rod. We have seen a variety of press drain rod in daily life and on the market, most of which are metal drain rods or plastic drain rods. The bounce switch component used in the press drain rod has a large bounce sound during daily use, causing a certain noise impact. In the prior art, the structure of the bounce switch component is mostly fixed by thread, and thread glue is used to connect and fix in order to prevent loosening. When the water drop head is blocked by debris, whole drain rod needs to be removed for cleaning up debris during cleaning operation, which is difficult for ordinary users to operate, and seriously affects user experience. When the bounce switch component fails, the bounce switch component cannot be replaced because the bounce switch component is fixed by thread glue, and so whole drain rod needs to be replaced, which greatly increases maintenance cost of the user. In order to occupy the market and obtain benefits, most of products only are changed in shape and surface, and is no difference, which can not satisfy user needs and obtain market benefits.

DESCRIPTION

A purpose of the utility is to solve at least above problems and to provide at least advantages that will be described later.

Another purpose of the utility is to provide a press water drop head device convenient for cleaning and having low noise. The press water drop head device has a simple and compact structure, reduces noise generated during pressing, and prevents the water drop head device out of sewer pipe during erroneous operation. The bounce switch component can be quickly removed. The press water drop head device has advantage of saving time, use safety, energy saving and environmental protection.

In view of purposes mentioned above and other advantages, the utility provides a press water drop head device convenient for cleaning and having low noise, which is connected with a sewer pipe, comprising:

a bounce component comprising a fixing casing, a sliding block, a pressing spring, a sliding guide rod, a cover plate, a sidewall of the fixing casing being provided with a residual hole, and the sidewall of the fixing casing being provided with a fixing column disposed below the residual hole, and the sliding block being vertically slidably sleeved in the fixing casing, a sliding rail being disposed on a sidewall of the sliding block, the pressing spring being vertically disposed, one end of the pressing spring being fixedly connected to the bottom end of the sliding block, and the other end being disposed in the fixing casing, and one end of the sliding guide rod being rotatably sleeved on the fixing column, and the other end extending through the residual hole into the fixing casing to contact the sliding rail, and the cover plate covering the residual hole and the sliding guide rod, and being detachably located on the fixing casing;

wherein a pair of protrusions are disposed on an outer circumference of the fixing casing, and the sewer pipe is provided with a pair of clamp holes matched with the pair of protrusions, so that the fixing casing is rotatably clamped with the sewer pipe.

Preferably, the outer wall of the fixing casing is circumferentially spaced with a plurality of split-flow pieces.

Preferably, the sewer pipe is provided with a retaining ring and a drain hole, and the retaining ring is sleeved on the outer wall of the top end of the sewer pipe, and the sewer pipe is sleeved with a first sealing gasket, a second sealing gasket and a nut from top to bottom.

Preferably, the sliding rail includes a first rail, a second rail, and a third rail communicated with each other, a guiding block is formed between the first rail, the second rail, and the third rail, the contact portion of the guiding block and the third rail is provided with a V-shaped notch, the first rail and the second rail form a Y-shape, the third rail is V-shaped, and the apex thereof and the projection of the apex of the V-shaped notch of the guiding block in the horizontal plane do not coincide.

Preferably, the sliding guide rod is an L-shaped structure.

Preferably, the press water drop head device also comprises a sewer cover that is detachably disposed at a top end of the sliding block, the sewer cover includes an integrally formed cover body and a transition pipe, and the transition pipe is sleeved with a sealing ring.

Preferably, the pair of protrusions are symmetrically arranged with respect to the fixing casing.

Preferably, the side wall of the fixing casing is recessed inwardly to form a receiving groove, the residual hole is located at the bottom of the receiving groove, and the cover plate is detachably fastened on the receiving groove.

Preferably, a filtering component is disposed at the lower part of the fixing casing, the filtering component is located in the sewer pipe, the filtering component includes a vertically disposed support sleeve, a vibration spring vertically disposed in the support sleeve, and a vertex downward conical filter screen, the support sleeve comprising an outer sleeve and an inner sleeve, an upper end of the outer sleeve being fixed to the bottom end of the fixing casing, and a lower end of the inner sleeve being fixed to the conical filter screen, the upper end of the vibration spring being fixed on the bottom end of the fixing casing, and the lower end being fixed on the apex of the conical filter screen, and the edge of the conical filter screen being provided with a circle of cleaning teeth, and the cleaning teeth being composed of a plurality of a nylon rods, a plurality of nylon rods extending in a direction of main line of the conical filter screen to be in contact with an inner wall of the sewer pipe, the conical filter screen being peripherally spaced with a plurality of rolling members, each of the rolling members comprising a roller disposed at the conical filter screen and a ball sleeved on the roller, the ball contacting the inner wall of the sewer pipe, the ball being located directly below the cleaning teeth.

The utility includes at least the following advantages:

The utility has simple and compact structure, and reduces noise generated when pressing. After installation at the sewer pipe, the press water drop head device is not pulled up when handling the rubbish blocked in the sewer pipe, causing water leakage. It also prevents the water drop head device out of sewer pipe during erroneous operation. The bounce component can be quickly removed when cleaning is needed, which saves time. The bounce component is only replaced if necessary without replacing other components, thereby reducing the maintenance cost for the user. The utility have advantage of use safety, energy saving and environmental protection.

Other advantages, objects, and features of the utility will be showed in part through following description, and in part will be understood by those skilled in the art from study and practice of the utility.

DETAILED DESCRIPTION

Figure 1:
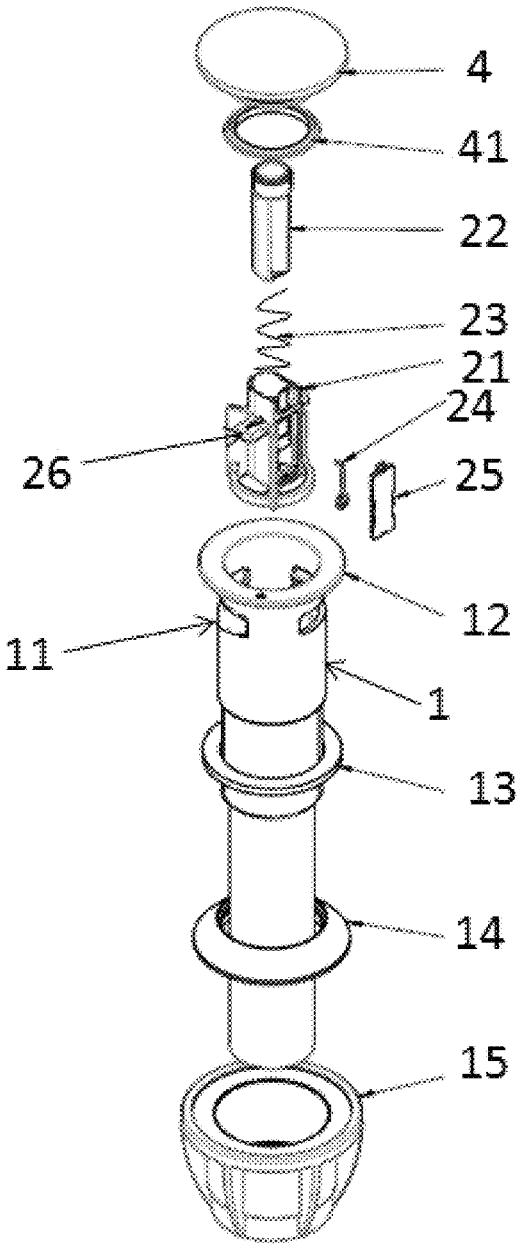
FIG. 1 is a structural view of the overall structure according to one of the technical solutions of the utility.

The utility will now be described in further detail with reference to the accompanying drawings in order to enable person skilled in the art to practice with reference to the description.

It should be noted that terms of "having", "containing" and "including" as used herein do not exclude presence or addition of one or more other elements or combinations thereof. It should be noted that in the description of the utility, the terms of "transverse", "longitudinal", "axial", "radial", "up", "down", "front", "behind", "left", "right", "vertical", "horizontal", "top", "bottom", "inner", "outer" and the like are based on the orientation or positional relationship shown in the drawings for convenience of describing the utility and simplifying description. It is not intended or implied that the device or element must have a particular orientation and be constructed and operated in a particular orientation, and therefore it should not be construed as limiting the utility.

Figure 2:
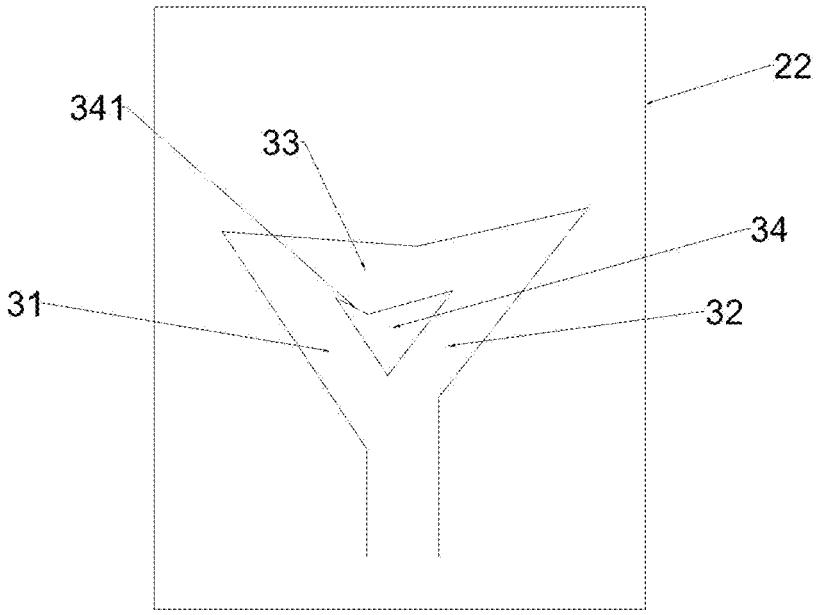
FIG. 2 is a structural view of the sliding rail according to one of the technical solutions of the utility.
Figure 3:
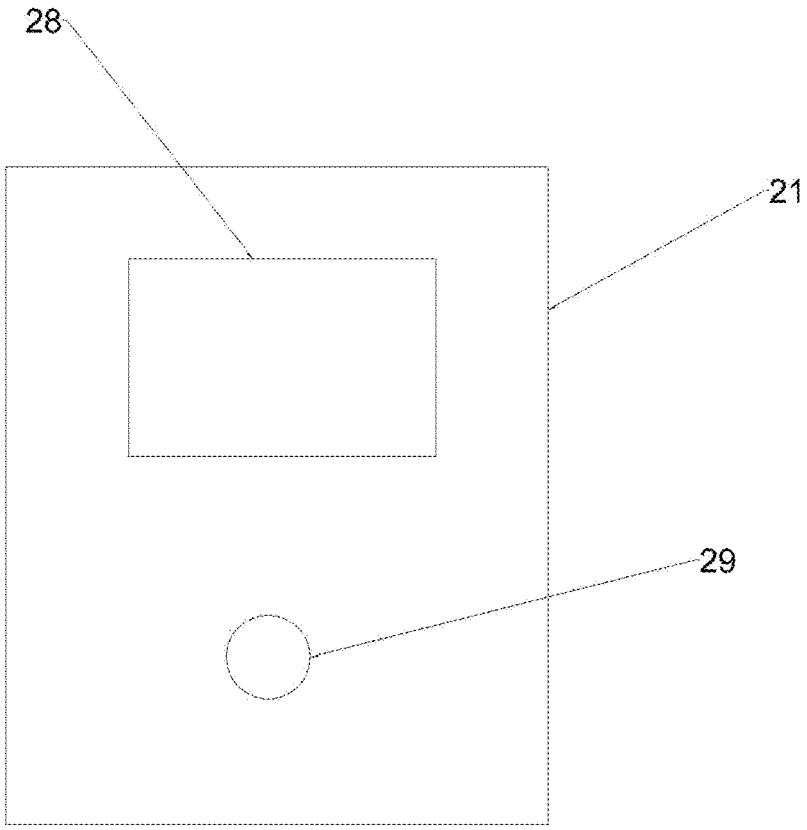
FIG. 3 is a partial structural view of a side wall of the fixing casing according to one of the technical solutions of the utility.

As shown in FIG. 1 to FIG. 3, the utility provides a press water drop head device convenient for cleaning and having low noise, which is connected with a sewer pipe 1, comprising:

a bounce component comprising a fixing casing 21, a sliding block 22, a pressing spring 23, a sliding guide rod 24, a cover plate 25. A sidewall of the fixing casing 21 is provided with a residual hole 28, and the sidewall of the fixing casing 21 is provided with a fixing column 29 disposed below the residual hole 28. The sliding block 22 is vertically slidably sleeved in the fixing casing 21. A sliding rail is disposed on a sidewall of the sliding block 22. The pressing spring 23 is vertically disposed, one end of the pressing spring is fixedly connected to the bottom end of the sliding block 22, and the other end is disposed in the fixing casing 21. One end of the sliding guide rod 24 is rotatably sleeved on the fixing column 29, and the other end extends through the residual hole 28 into the fixing casing 21 to contact the sliding rail. The cover plate 25 covers the residual hole 28 and the sliding guide rod 24, and is detachably located on the fixing casing 21;

wherein a pair of protrusions 26 are disposed on an outer circumference of the fixing casing 21, and the sewer pipe 1 is provided with a pair of clamp holes 11 matched with the pair of protrusions 26, so that the fixing casing 21 is rotatably clamped with the sewer pipe 1.

The utility is applied to an appliance which needs to be drained, such as a washbasin or a bathtub. The bottom of the washbasin or the bathtub is usually provided with a through hole for installing the drainage structure, and the sewer pipe 1 is arranged in the through hole, and the top end of the sewer pipe 1 is preferably level with the bottom of the washbasin or the bathtub. During installation, the pressing spring 23 is first placed in the fixing casing 21, and the sliding block 22 is inserted into the fixing casing 21 and abutted on the pressing spring 23. The sliding rail on the sliding block 22 is directed toward the residual hole 28 so that the sliding rail is exposed from the residual hole 28 when pressing the sliding block 22 downward. One end of the sliding guide rod 24 is rotatably sleeved on the fixing column 29, and the other end extends through the residual hole 28 into the fixing casing 21 and then abuts the sliding rail. The residual hole 28 has a large enough area to ensure that the sliding guide rod 24 can smoothly slide along the sliding rail when pressed. Then, the cover plate 25 covers the residual hole 28 and the sliding guide rod 24, and then covers the fixing casing 21. And then the fixing casing is inserted into clamp holes 11 through the pair of protrusions 26. The protrusions 26 and the clamp holes 11 are any form of structure capable of rotating and clamping in the prior art. Rotating and clamping includes rotating and clamping during assembly, and reverse rotating for removing clamping during disassembly, and no water leakage when clamping. Inner walls of the fixing casing 21 and the sewer pipe 1 have a gap for drainage. When the utility is used, the sewer cover 4 is connected with the top end of the sliding block 22. When the sliding block 22 is subjected to a downward pressing force, the pressing spring 23 is compressed, forcing the sliding guiding rod 24 to slide along the sliding rail. When the downward pressing force on the sliding block 22 is cancelled, the sliding guide rod 24 stays at a lower position of the sliding rail, the edge of the sewer cover 4 contacts with the bottom of the washbasin or the bathtub and blocks the sewer pipe 1. When the sliding block 22 is again subjected to a downward pressing force, the pressing spring 23 is compressed, forcing the sliding guide rod 24 to slide along the sliding rail. And when the downward pressing force on the sliding block 22 is cancelled, the sliding guide rod 24 stays at a upper position of the sliding rail, the edge of the sewer cover 4 moves upward and away from the bottom of the washbasin or the bathtub, and the water in the washbasin or the bathtub is discharged through the sewer pipe 1.

The utility has simple and compact structure, and reduces noise generated when pressing. After installation at the sewer pipe 1, the press water drop head device is not pulled up when handling the rubbish blocked in the sewer pipe 1, causing water leakage. It also prevents the water drop head device out of sewer pipe 1 during erroneous operation. The bounce component can be quickly removed when cleaning is needed, which saves time. The bounce component is only replaced if necessary without replacing other components, thereby reducing the maintenance cost for the user. The utility have advantage of use safety, energy saving and environmental protection.

In another technical solution, the outer wall of the fixing casing 21 is circumferentially spaced with a plurality of split-flow pieces 27, so that a plurality of spaces are formed between the fixing casing 21 and the sewer pipe 1 for drainage.

In another technical solution, the sewer pipe 1 is provided with a retaining ring 12 and a drain hole, and the retaining ring 12 is sleeved on the outer wall of the top end of the sewer pipe 1, and the sewer pipe 1 is sleeved with a first sealing gasket 13, a second sealing gasket 14 and a nut 15 from top to bottom. In use, the first sealing gasket 13 is disposed under the retaining ring 12, the first sealing gasket 13 is attached to upper surface of the bottom of the washbasin or the bathtub, and the second sealing gasket 14 is attached to lower surface of the bottom of the washbasin or the bathtub, and the drain hole is communicated with and the overflow hole in the washbasin or bathtub.

In another technical solution, the sliding rail includes a first rail 31, a second rail 32, and a third rail 33 communicated with each other, a guiding block 34 is formed between the first rail 31, the second rail 32, and the third rail 33, the contact portion of the guiding block 34 and the third rail 33 is provided with a V-shaped notch 341, and the first rail 31 and the second rail 32 form a Y-shape. The third rail 33 is V-shaped, and the apex thereof and the projection of the apex of the V-shaped notch 341 of the guiding block 34 in the horizontal plane do not coincide, so that the sliding guide rod 24 can smoothly slide to the left part or the right side of the third rail 33. The end of the sliding guide rod 24 against the sliding rail is located at the V-shaped notch 341 of the guiding block 34 when the water drop head structure of the utility blocks the sewer pipe 1. The end of the sliding guide rod 24 against the sliding rail is located at the lower end of the Y-shape formed by the first rail 31 and the second rail 32 when the water drop head structure of the utility is drained. When the apex of the V-shape of the third rail 33 is on the left side of the apex of the V-shaped notch 341 of the guiding block 34, when pressing, the end of the sliding guide rod 24 against the sliding rail slides from the V-shaped notch 341 of the guiding block 34 along the left portion of the third rail 33, the first rail 31 (or the second rail 32) in sequence. The end of the sliding guide rod 24 against the sliding rail stays at the lower end of the Y-shape formed by the first rail 31 and the second rail 32 at the instant of canceling pressing. When pressing again, the end of the sliding guide rod 24 against the sliding rail slides from the lower end of the Y-shape formed by the first rail 31 and the second rail 32 along the second rail 32 (or the first rail 31), the right portion of the third rail 33 in sequence. The end of the sliding guide rod 24 against the sliding rail stays at the V-shaped notch 341 of the guiding block 34 at the moment of canceling pressing. When the apex of the V-shape of the third rail 33 is on the right side of the apex of the V-shaped notch 341 of the guiding block 34, the sliding process at the time of pressing is mirror symmetrical with described above on the left side.

In another technical solution, the sliding guide rod 24 is an L-shaped structure, which is simple and practical.

In another technical solution, the press water drop head device also comprises a sewer cover 4 that is detachably disposed at a top end of the sliding block 22, the sewer cover 4 includes an integrally formed cover body and a transition pipe, and the transition pipe is sleeved with a sealing ring 41. The transition pipe extends into the sewer pipe 1 and for ensuring sealing without leakage when plugging.

In another technical solution, the pair of protrusions 26 are symmetrically arranged with respect to the fixing casing 21 for easy rotating and snapping.

In another technical solution, the side wall of the fixing casing 21 is recessed inwardly to form a receiving groove, the residual hole 28 is located at the bottom of the receiving groove, and the cover plate 25 is detachably fastened on the receiving groove, which has a clever design and beautiful appearance.

Figure 4:
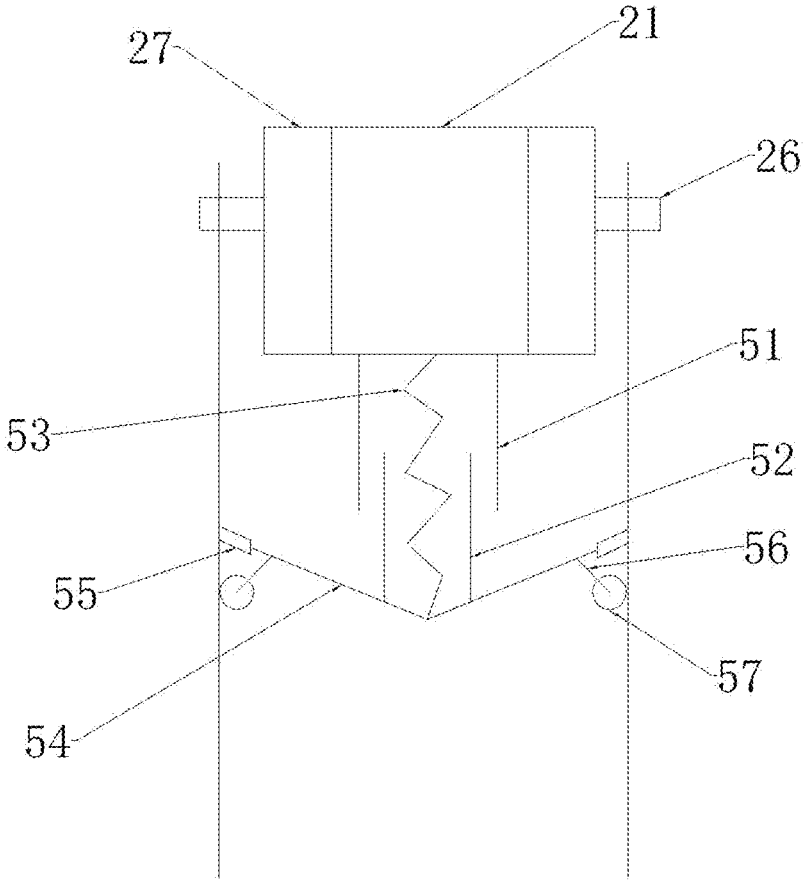
FIG. 4 is a structural view of the filtering component according to one of the technical solutions of the utility.

In another technical solution, as shown in FIG. 4, a filtering component is disposed at the lower part of the fixing casing 21, the filtering component is located in the sewer pipe 1, the filtering component includes a vertically disposed support sleeve, a vibration spring 53 vertically disposed in the support sleeve, and a vertex downward conical filter screen 54. The support sleeve comprises an outer sleeve 51 and an inner sleeve 52, an upper end of the outer sleeve 51 is fixed to the bottom end of the fixing casing 21, and a lower end of the inner sleeve 52 is fixed to the conical filter screen 54. The upper end of the vibration spring 53 is fixed on the bottom end of the fixing casing 21, and the lower end is fixed on the apex of the conical filter screen 54. The edge of the conical filter screen 54 is provided with a circle of cleaning teeth 55, and the cleaning teeth 55 is composed of a plurality of a nylon rods. A plurality of nylon rods extend in a direction of main line of the conical filter screen 54 to be in contact with an inner wall of the sewer pipe 1. The conical filter screen 54 is peripherally spaced with a plurality of rolling members. Each of the rolling members comprises a roller 56 disposed at the conical filter screen 54 and a ball 57 sleeved on the roller 56, the ball 57 contacts the inner wall of the sewer pipe 1, and the ball 57 is located directly below the cleaning teeth 55.

In this technical solution, when draining, the conical filter screen 54 can filter part of the waste material, which is convenient for regular cleaning, avoiding blocking the sewer pipe 1. The conical filter screen 54 generates vibration up and down under impact of the water flow, so that some small wastes flow away with the water flow. The design of the ball 57 is such that the sliding friction is converted into rolling friction when the conical filter screen 54 vibrates, reducing the friction and avoiding additional noise. The cleaning teeth 55 is preferably a rod-shaped body made of nylon having a certain hardness, which can clean the inner wall of the sewer pipe 1 when vibrating.

Although the embodiments of the utility have been disclosed above, they are not limited to the applications previously mentioned in the specification and embodiments, and can be applied in various fields suicountertop for the utility. For ordinary skilled person in the field, other various changed model, formula and parameter may be easily achieved without creative work according to instruction of the utility, changed, modified and replaced embodiments without departing the general concept defined by the claims and their equivalent are still included in the utility. The utility is not limited to particular details and illustrations shown and described herein.

What is claimed is:

1. A press water drop head device convenient for cleaning and having low noise, which is connected with a sewer pipe, being characterized in that, comprises:

a bounce component comprising a fixing casing, a sliding block, a pressing spring, a sliding guide rod, a cover plate, a sidewall of the fixing casing being provided with a residual hole, and the sidewall of the fixing casing being provided with a fixing column disposed below the residual hole, and the sliding block being vertically slidably sleeved in the fixing casing, a sliding rail being disposed on a sidewall of the sliding block, the pressing spring being vertically disposed, one end of the pressing spring being fixedly connected to the bottom end of the sliding block, and the other end being disposed in the fixing casing, and one end of the sliding guide rod being rotatably sleeved on the fixing column, and the other end extending through the residual hole into the fixing casing to contact the sliding rail, and the cover plate covering the residual hole and the sliding guide rod, and being detachably located on the fixing casing;

wherein a pair of protrusions are disposed on an outer circumference of the fixing casing, and the sewer pipe is provided with a pair of clamp holes matched with the pair of protrusions, so that the fixing casing is rotatably clamped with the sewer pipe.

2. A press water drop head device convenient for cleaning and having low noise according to claim 1, being characterized in that, the outer wall of the fixing casing is circumferentially spaced with a plurality of split-flow pieces.

3. The press water drop head device convenient for cleaning and having low noise according to claim 1, being characterized in that, the sewer pipe is provided with a retaining ring and a drain hole, the retaining ring is sleeved on the outer wall of the top end of the sewer pipe, and the sewer pipe is sleeved with a first sealing gasket, a second sealing gasket and a nut from top to bottom.

4. The press water drop head device convenient for cleaning and having low noise according to claim 1, being characterized in that, the sliding rail includes a first rail, a second rail, and a third rail communicated with each other, a guiding block is formed between the first rail, the second rail, and the third rail, the contact portion of the guiding block and the third rail is provided with a V-shaped notch, the first rail and the second rail form a Y-shape, the third rail is V-shaped, and the apex thereof and the projection of the apex of the V-shaped notch of the guiding block in the horizontal plane do not coincide.

5. The press water drop head device convenient for cleaning and having low noise according to claim 1, being characterized in that, the sliding guide rod is an L-shaped structure.

6. The press water drop head device convenient for cleaning and having low noise according to claim 1, being characterized in that, also comprises a sewer cover detachably disposed at a top end of the sliding block, the sewer cover includes an integrally formed cover body and a transition pipe, and the transition pipe is sleeved with a sealing ring.

7. The press water drop head device convenient for cleaning and having low noise according to claim 1, being characterized in that, the pair of protrusions are symmetrically arranged with respect to the fixing casing.

8. The press water drop head device convenient for cleaning and having low noise according to claim 1, being characterized in that, the side wall of the fixing casing is recessed inwardly to form a receiving groove, the residual hole is located at the bottom of the receiving groove, and the cover plate is detachably fastened on the receiving groove.

9. The press water drop head device convenient for cleaning and having low noise according to claim 1, being characterized in that, a filtering component is disposed at the lower part of the fixing casing, the filtering component is located in the sewer pipe, the filtering component includes a vertically disposed support sleeve, a vibration spring vertically disposed in the support sleeve, and a vertex downward conical filter screen, the support sleeve comprising an outer sleeve and an inner sleeve, an upper end of the outer sleeve being fixed to the bottom end of the fixing casing, and a lower end of the inner sleeve being fixed to the conical filter screen, the upper end of the vibration spring being fixed on the bottom end of the fixing casing, and the lower end being fixed on the apex of the conical filter screen, and the edge of the conical filter screen being provided with a circle of cleaning teeth, and the cleaning teeth being composed of a plurality of a nylon rods, a plurality of nylon rods extending in a direction of main line of the conical filter screen to be in contact with an inner wall of the sewer pipe, the conical filter screen being peripherally spaced with a plurality of rolling members, each of the rolling members comprising a roller disposed at the conical filter screen and a ball sleeved on the roller, the ball contacting the inner wall of the sewer pipe, the ball being located directly below the cleaning teeth.

* * * * *